US006041468A

United States Patent [19]

Chen et al.

[11] Patent Number: 6,041,468

[45] Date of Patent: Mar. 28, 2000

[54] PROPHY TOOTHBRUSH

[75] Inventors: Albert C Chen, East Brunswick; Kenneth G. Waguespack, North Brunswick; Douglas J. Hohlbein, West Trenton, all of N.J.

[73] Assignee: Colgate-Palmolive Company, New York, N.Y.

[21] Appl. No.: 09/041,458

[22] Filed: Mar. 12, 1998

[51] Int. Cl.[7] ..... A46B 9/04

[52] U.S. Cl. ..... 15/167.1; 15/207.2; 15/DIG. 5

[58] Field of Search ..... 15/167, 207.2, 15/DIG. 5; D9/104, 107, 132, 134

[56] References Cited

U.S. PATENT DOCUMENTS

| | | |
|---|---|---|
| D. 73,662 | 10/1927 | Lederer . |
| 74,560 | 2/1868 | Maury . |
| D. 121,506 | 7/1940 | Davis . |
| D. 122,388 | 2/1940 | Cohen . |
| D. 136,042 | 2/1943 | Veo . |
| 140,429 | 7/1873 | O'Donoghue et al. . |
| D. 201,867 | 8/1965 | Newman . |
| D. 243,568 | 3/1977 | Axelsson . |
| D. 248,696 | 8/1978 | Greenberg . |
| D. 281,202 | 11/1985 | Thompson . |
| D. 283,761 | 5/1986 | Chen . |
| D. 332,873 | 2/1993 | Hall . |
| D. 334,473 | 4/1993 | Volpenheim et al. . |
| D. 334,842 | 4/1993 | Lemon et al. . |
| D. 352,175 | 11/1994 | Brown . |
| D. 358,259 | 5/1995 | Sears . |
| D. 358,486 | 5/1995 | Loew . |
| D. 358,712 | 5/1995 | Loew . |
| D. 359,851 | 7/1995 | Loew . |
| D. 363,373 | 10/1995 | Heinzelman et al. . |
| D. 364,740 | 12/1995 | Loew . |
| D. 368,803 | 4/1996 | Yost et al. . |
| D. 368,804 | 4/1996 | Yost et al. . |

(List continued on next page.)

FOREIGN PATENT DOCUMENTS

| | | |
|---|---|---|
| 567187 | 2/1929 | France . |
| 1430328 | 12/1966 | France . |
| 694250 | 7/1940 | Germany . |
| 813148 | 7/1949 | Germany . |
| 909768 | 7/1949 | Germany . |
| 36 07 200 | 9/1987 | Germany . |
| 325419 | 3/1935 | Italy . |
| 85401 | 2/1936 | Sweden . |
| 266327 | 4/1950 | Switzerland . |
| 278938 | 10/1927 | United Kingdom . |
| 308097 | 4/1928 | United Kingdom . |
| 490892 | 8/1938 | United Kingdom . |
| 705725 | 3/1954 | United Kingdom . |
| WO 81/00804 | 4/1981 | WIPO . |
| WO 93/14671 | 8/1993 | WIPO . |
| WO 97/25898 | 7/1997 | WIPO . |

*Primary Examiner*—Terrence R. Till

*Attorney, Agent, or Firm*—Henry S. Goldfine; Richard J. Ancel

[57] ABSTRACT

A toothbrush having a novel bristle configuration and trim pattern is described. The bristles of the tufts are of varying lengths and are so arranged to form a concave shape resembling the shape of a rubber prophy cup used by dentists and hygienists for polishing teeth. The individual bristles are of varying length and so placed into or mounted in the head to yield tufts having the same concave shape but without the requirement for trimming the bristle ends. In a variant construction, the upper ends of a number of tufts are so contoured, either by trimming or by insertion of various length bristles, that each tuft upper end has a surface which is a portion of a larger concave surface. Thus in one type of arrangement each tuft has its own prophy brush shape at its upper end. In another type of arrangement there is only one prophy brush shape for the entire head, each tuft making its own partial contribution to the single prophy shape. In between these two arrangements, other arrangements are possible, with each subset of the total number of tufts defining a single prophy shape. The tufts may be single-bristle tufts, as well as the more common plural bristle tufts.

4 Claims, 3 Drawing Sheets

U.S. PATENT DOCUMENTS

D. 370,347 6/1996 Henzelman et al. .
D. 372,363 8/1996 Halm .
D. 372,584 8/1996 Yost et al. .
D. 373,681 9/1996 Yost et al. .
D. 374,122 10/1996 Yost et al. .
D. 374,350 10/1996 Yost et al. .
D. 374,775 10/1996 Yost et al. .
D. 380,302 7/1997 Volpenhein .
560,663 5/1896 Wallas .
741,722 10/1903 Ryder et al. .
1,048,740 12/1912 Sarrazin .
1,059,426 4/1913 Barnes .
1,211,468 1/1917 McLean .
1,268,544 6/1918 Cates .
1,323,042 11/1919 Gardner .
1,327,757 1/1920 Eggers .
1,369,966 3/1921 Cosens et al. .
1,588,785 6/1926 van Sant .
1,619,946 3/1927 Magee .
1,682,946 8/1928 Bigoney .
1,691,863 11/1928 van Sant .
1,850,233 3/1932 Herman .
1,861,347 5/1932 Johnson .
1,889,495 11/1932 Priest .
1,901,646 3/1933 Hicks .
1,914,240 6/1933 Caldwell .
1,943,225 1/1934 McIntyre .
1,965,009 7/1934 Stevens .
2,040,245 5/1936 Crawford .
2,043,898 6/1936 Malcolm .
2,111,876 3/1938 Swenson .
2,117,174 5/1938 Jones .
2,149,950 3/1939 Axline .
2,155,473 4/1939 Coleman .
2,161,349 6/1939 Hadden .
2,186,005 1/1940 Casto .
2,241,584 5/1941 Cohen .
2,279,355 4/1942 Wilensky .
2,312,828 3/1943 Adamsson .
2,483,503 10/1949 Pollack .
2,684,063 7/1954 Bileth .
2,860,011 11/1958 Dunn .
2,978,724 4/1961 Gracian .
3,007,441 11/1961 Eyer .
3,188,673 6/1965 Newman .
3,378,870 4/1968 Matsunaga .
3,412,731 11/1968 Reynolds .
3,633,237 1/1972 Bagube .
3,742,549 7/1973 Scopp et al. .
3,792,504 2/1974 Smith .
3,840,932 10/1974 Balamuth .
3,934,298 1/1976 Kim .
3,994,038 11/1976 Moulet .
3,994,039 11/1976 Hadary .
4,020,521 5/1977 Velasquez .
4,330,896 5/1982 Booth .
4,524,478 6/1985 Ross .
4,570,282 2/1986 Kaufman et al. .
4,610,045 9/1986 Rauch .
4,617,694 10/1986 Bori .
4,776,054 10/1988 Rauch .
4,847,936 7/1989 Moglianesi et al. .
4,869,277 9/1989 Olsen .
4,894,880 1/1990 Aznavoorian .
5,065,470 11/1991 Diamond .
5,109,563 5/1992 Lemon et al. .
5,143,424 9/1992 Boucherie .
5,325,560 7/1994 Pavone .
5,342,284 8/1994 Lemon .
5,383,244 1/1995 Ahrens .
5,392,483 2/1995 Heinzelman et al. .
5,396,678 3/1995 Bredal et al. .
5,438,726 8/1995 Leite .
5,459,898 10/1995 Bacolot .
5,459,899 10/1995 Bauer .
5,471,702 12/1995 Schmitt .
5,511,275 4/1996 Volpenhein et al. .
5,570,487 11/1996 Schneider .
5,604,951 2/1997 Shipp .
5,655,249 8/1997 Li .
5,678,274 10/1997 Liu .
5,694,658 12/1997 Huang et al. .
5,873,140 2/1999 Holloway ..... 15/167.1

PROPHY TOOTHBRUSH

BACKGROUND OF THE INVENTION

This invention relates to a novel head and bristle configuration for the trim pattern of a toothbrush. The bristles are arranged in tufts and the bristle ends of each tuft are trimmed to produce a concave shape. Such a concavity resembles the concavity of a rubber prophy cup used by dentists when polishing tooth surfaces.

While a rubber prophy brush is widely known, it is not in general known to employ bristle trim patterns that resemble the shape of rubber prophy cups. Instead, virtually all the known toothbrushes and designs had the following trim patterns covering the entire bristle field: flat, bi-level, multi-level, curved, slanted, saw-tooth, wavy, etc.

Toothbrushes having bristles arranged in a single "mat" covering substantially the entire area of the bristle face are known, e.g., in U.S. Pat. No. 4,646,381, which also discloses a toothbrush having a combination of circular sectioned tufts, oval sectioned and rectangular sectioned tufts located within a middle are of a larger mat of individual bristles covering a substantial area of the bristle face. U.S. Pat. No. 4,268,933 discloses a toothbrush having bristles arranged in large tufts of a rectangular shape, having their long dimension aligned substantially across the width of the toothbrush head. U.S. Pat. No. 2,209,173 discloses a toothbrush having elongated rectangular tufts of bristles with their long dimension aligned substantially parallel to the toothbrush axis, alternating with rectangular tufts which tilt together, the bristles in the tufts being flattened to form a sharp-edged tuft.

Bristle tufts having a substantially circular cross section have substantially the same stiffness to bending perpendicular to the longitudinal axis of the bristles in the tuft ("the tuft axis") whether this direction is parallel to the toothbrush axis or perpendicular to the toothbrush axis, i.e., across the width of the toothbrush. This can have the disadvantage that the tufts have substantially the same stiffness when the head is being moved generally in the direction of the toothbrush axis across the teeth parallel to the gumline, as when the head is being moved in a direction generally perpendicular to the toothbrush axis, up and down the teeth, crossing the gumline. It is desirable that a toothbrush is softer, i.e., has less stiffness to bend when brushing across the gumline, to prevent injury to the gumline.

U.S. Pat. No. 2,317,485, to Rider, issued Apr. 27, 1943, relates to a toothbrush with improved cleaning ability due to the shape and nature of the bristles. The Rider invention stems from the observation that circular cross-sectional bristles do not pack into tuft holes well and that other regular geometric shapes, e.g., triangles, squares, pentagons, hexagons, heptagons, and octagons, allow one to pack more bristles into a given tuft hole. Also, U.S. Pat. No. 2,876,477 to Stewart, issued Mar. 10, 1959, relates to another toothbrush which utilizes polygons of regular cross-sections, e.g., squares, pentagons, hexagons, heptagons, octagons, nonagons, etc. Contrary to Rider, Stewart seeks to maximize interstitial spacing by providing these polygons with a concave contour on each side. Still further, U.S. Pat. No. 3,032,230 to Poppelman, issued Feb. 7, 1967, relates to a toothbrush wherein the bristles, head and handle are molded into a single unit. Poppelman indicates that the preferred bristle cross-section should be of a polygon with at least two acute angles, e.g., triangle, rhombus, and a four-pointed star pattern.

Conventional, perpendicularly oriented bristle tufts tend to act as a series of columns and thus support suspended bristles as they pass over embrasures. This minimized overall compression strength afforded by this angle configuration allows individual tufts of bristles to penetrate embrasures, sub-gingival and interproximal spaces without being inhibited from doing so by surrounding bristle tufts.

Angled tufts move in the direction of their angle. As downward and horizontal force is applied to the brush head, tufts of bristle skid across tooth surfaces generally in the direction dictated by the angle of the tuft hole in which the bristles are anchored to the brush head rather than simply curling back in the opposite direction in which they are pushed. The preferred construction is to integrate multi-directional motion of bristles during unidirectional actuation of the brush.

When forced into the direction of their angle, bristles will spring out of crevasses as stresses are exceeded to contain them in place. This dynamic action will tend to fling plaque out of interproximal spaces. Conventional devices tend to pack plaque into spaces as the bristle tufts sweep over embrasures.

The weak flexure strength of spaced individual bristle tufts allows for the reduction of bristle height without causing the sensation of increased bristle stiffness. Conventional brushes trimmed to a shorter height are perceptibly stiffer and tend to cause trauma to the mucosa. Minimized bristle height allows for greater clearance (and thus enhance reach to the rear molars) between the buccal surfaces of the teeth and the mucosal lining.

Angled tufts of bristle will assume varying heights as they are deformed, yet will be uniform in height when not in use. Angled bristles will project above the tips of straight bristles as the former are forced into a perpendicular orientation during use. This effect, caused by the greater length of the hypotenuse of a triangle, allows for the angled tufts to reach deeply into the interproximal and gingival marginal areas as perpendicular orientation is assumed.

There are a number of known toothbrush constructions, however, none appear to exhibit a tuft arrangement which performs several tooth and gumline cleaning functions regardless of the style or technique employed for brushing. While a number of toothbrush manufacturers print specific brushing techniques on their brush containers, if a purchaser does not pay attention to them, or forgets them, then less than optimum teeth cleaning results.

EP-A-022 1000 discloses a toothbrush for a special use namely for teeth controlled by orthodontic braces. It has a line of central bristles perpendicular to the head and bristles located on either side and near the center and tilted outwardly and bristles located near the edges of the head and tilted inwardly. The bristles are not arranged in rows transverse to the head. The relationship of the tilted bristles to the perpendicular bristles appears to be random.

U.S. Pat. No. 2,168,984 discloses a single central perpendicular bristle 6, then a pair of perpendicular bristles 4 along the head towards the handle, then a pair of inwardly inclined bristles 3, then four bristles 2,5,5,2, the outer two 2,2 being perpendicular and the inner bristles 5,5 being inclined outwardly. The rows (4,4), 3,3) and (2,5,5,2) then repeat and the head ends with a row (4,4).

Swiss Patent CH-A-324623 has two bristles inclined to the same side at the tip and then alternating rows of three bristles, all the bristles in one row being inclined to the same side and the inclination alternating from row to row.

Brushes may be manufactured by any one of several technologies currently available. The body itself, as noted above, may be injection molded, in a single or multistep process. While certain of the bristles may be attached by staples as is conventional, the bristle bars, scoops and other densely packed bristles generally must be attached using newer staple-free technology such as fusion or injection molding, with the latter often being employed. Fusion technology, whereby the brush body is preformed then softened and the bristle tufts are melted and fused to the softened brush body is useful.

Injection molding is carried out on machinery which is known in the following patents, each of which is expressly incorporated herein by reference: U.S. Pat. No. 4,430,039, issued Feb. 7, 1984; U.S. Pat. No. 4,580,845, issued Apr. 8, 1986; U.S. Pat. No. 5,143,425, issued Sep. 1, 1992; and U.S. Pat. No. 5,390,984, issued Feb. 21, 1995.

Other useful techniques for attaching bristles to a body, such as thermoforming, fusion, welding, and the like are illustrated in the following patents, which are expressly incorporated herein by reference: U.S. Pat. No. 4,109,965, issued Aug. 29, 1978; U.S. Pat. No. 4,619,485 issued Oct. 28, 1986; U.S. Pat. No. 4,637,660 issued Jan. 20, 1987; U.S. Pat. No. 4,646,381 issued Mar. 3, 1987; U.S. Pat. No. 4,892,698 issued Jan. 9, 1990; U.S. Pat. No. 5,045,267 issued Sep. 3, 1991; U.S. Pat. No. 4,988,146 issued Jan. 29, 1991; and U.S. Pat. No. 5,224,763 issued Jul. 6, 1993.

Prior to the availability of newer technology, it was customary to install bristles in toothbrush heads by the use of small staples. Several bristles (later to form a tuft), only slightly longer than twice the desired bristle length, were essentially folded about their mid lengths. The bight of the folded bristles is inserted into a respective hole in the head. Then a small staple is driven into the head substrate such that its legs or prongs entered the substrate and its bight portion bore against the bight of the folded bristles. Alternatively, the insertion of both the folded bristles and the staple was carried out at the same time. The holes in the toothbrush head were formed either by drilling or by molding.

By virtue of the newer technology the manufacturer of toothbrushes can insert single bristles into a toothbrush head without the need to first bend a plurality of them to thereby form a central bight portion or region against which a part of a staple abuts to anchor the bristles into place in the head. Thus each bristle may be individually customized to a specific and desired length prior to its insertion into the head. Further, instead of each tuft receiving hole requiring a diameter large enough to accommodate a bundle or group of folded bristles, the diameter need be only as large as the diameter of a single tuft. In turn this new manner of bristle attachment permits increased head strength due to the increased volume of substrate material between the several tufts of the head.

Staple-free attachment results in no holes in the brush body, where water can collect and bacteria grow. Most preferred is supplying the bristles to an injection mold, and injection molding the brush body around the bristles for a tight fit. Rubber grips may be injection molded over the body.

SUMMARY OF THE INVENTION

According to the practice of this invention a toothbrush is provided with individual tufts of bristles, the bristles of any tuft forming a prophy brush shape. Instead of this arrangement, namely, a prophy shape defined for the upper end of each tuft, subsets of tufts may form a single prophy shape. Thus the ends of three adjacent tufts may be so trimmed or their lengths so chosen that the ends of the bristles of each individual tuft of this triad form only a part of a complete prophy or concave shape, with all three tufts required to form a complete prophy shape. Similarly, instead of a subgroup of three tufts, subgroups of four, or five, etc., tufts may be employed with each subgroup forming a complete prophy shape. In yet another form of the invention, instead of the head being provided with a plurality of (multiple-bristle) tufts, each tuft may be a single-bristle tuft, with no two bristles touching each other. In this latter form, the entire number of single-bristle tufts on the toothbrush head may be attached by, for example, the fusion process. Then, the ends of the entire number of single-bristle tufts contoured to form a single concave shape, or alternatively, multiple subsets of the single-bristle tufts with each subset having a concave shape.

Depending on the size of a brush head, the number of prophy-cup-shaped groupings and the size of each grouping can vary. When a prophy brush is produced by conventional anchoring process, the bristles in each grouping can be the sum of individual tufts arranged in circular fashion. When a prophy brush is produced by anchorless in-mold tufting or fusion processes, the individual bristles can be spread out evenly to form a circular shape.

A prophy brush is not limited to having all the bristles arranged to form concave trims. The prophy-cup-shaped tufts may constitute part of the brush among tufts having different shapes and trim patterns. The word "concave" also covers any trim pattern where the inner bristles are shorter than the outer bristles. The groupings of bristles are not limited to a circular shape; they can be square, rectangular, oval, or any irregular shape.

One advantage of this invention is to improve the cleaning power of a toothbrush. The concave trim pattern has bristle heights that are lowest at the center of the concavity and highest at the outer rim. Such smooth gradation in bristle heights will yield maximum cleaning power since the long outer bristles penetrate below the gum lines, and the shorter inner bristles will scrub the enamel surfaces of the teeth. The prophy-cup-shaped trim pattern could also encourage a user to brush in a circular or up-and-down manner similar to the motion of a rubber prophy cup when a dentist or a hygienist is cleaning a patient's teeth. The concave trims can also be used as receptacles of toothpaste.

DETAILED DESCRIPTION OF THE INVENTION

Figure 1:
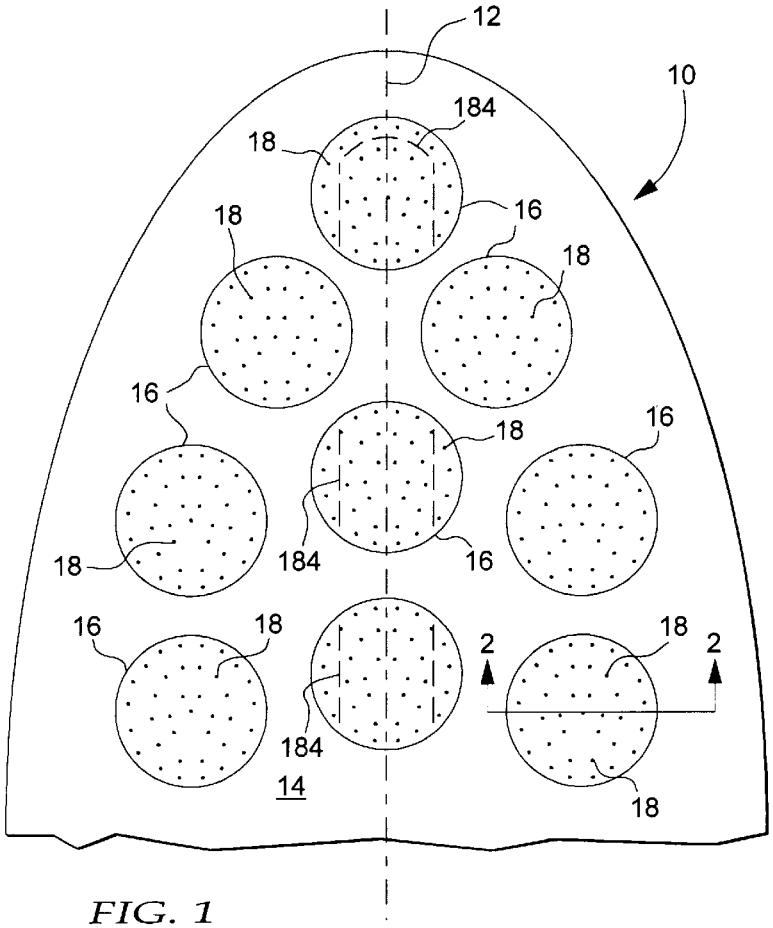
FIG. 1 is a top plan view of a portion of a toothbrush head having the prophy bristle construction of this invention, according to a first embodiment.
Figure 2:
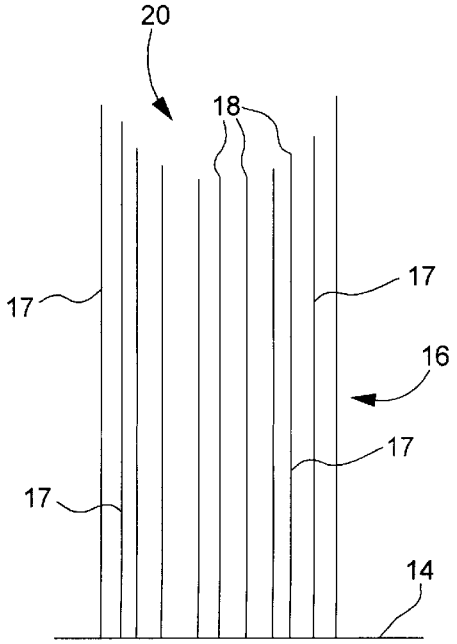
FIG. 2 is a typical longitudinal cross section of any of the tufts of FIG. 2.
Figure 3:
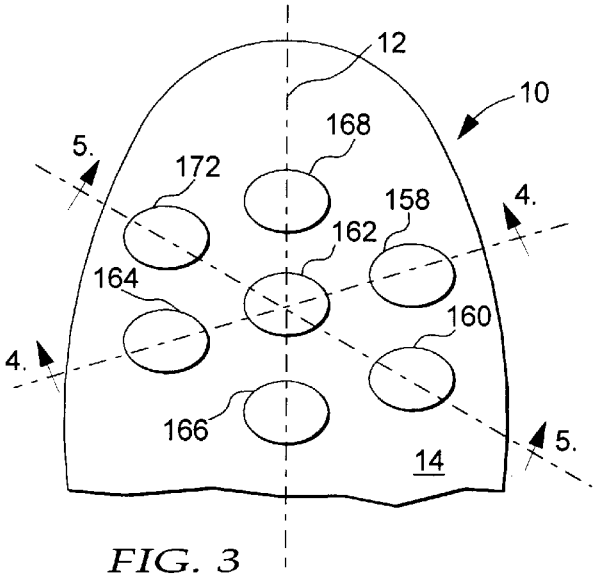
FIG. 3 is a top plan view of a portion of a toothbrush head having the prophy bristle construction of this invention, according to a second embodiment.

Referring now to FIG. 1 of the drawings, a toothbrush head 10 is illustrated in top plan, with only the forward or front portion of the head illustrated. It will be understood that the toothbrush has a longitudinal axis 12 extending along the handle and the head. The upper surface 14 of the head, being that surface facing the reader, with a plurality of tufts 16 of bristles extending upwardly and/or outwardly from head surface 14. The reader will understand that it is not essential for the practice of this invention that the tufts 16 extend at any particular angle from surface 14 of the head. Further, the particular pattern in which the tufts 16 are illustrated at FIG. 1 is not significant for carrying out the invention since the invention relates to the shape of the upper portions of each tuft 16. Reference now to FIGS. 2 and 3 will further illustrate this invention. At FIG. 2 the reader will see that the upper ends or tips 18 of each tuft 16 is such that these upper tips form a concave surface 20. The tips 18 as shown at FIG. 2 may form an arc of a circle, or the arc of a parabola, or any other desired concave form, so long as it is substantially smooth and continuous. The individual bristles 17 shown at FIG. 2 are in practice much more densely packed together than shown and their spacing from each other is usually uniform.

FIGS. 1 and 2 define a first embodiment of the invention wherein the upper ends of each tuft 16 form a single prophy-like brush. As seen at FIG. 2, the upper ends or tips 18 of individual tuft bristles 17 lie on and define a single imaginary concave surface denoted as 20. Each concave surface is smooth and continuous.

Figure 4:
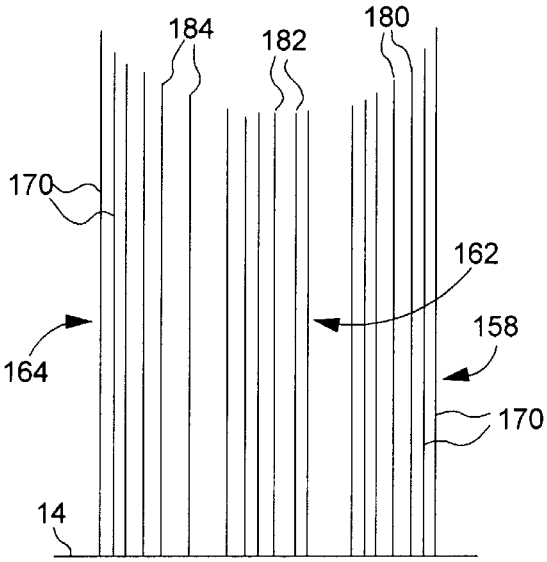
FIGS. 4 and 5 are views taken along respective sections 4—4 and 5—5 of FIG. 3.
Figure 5:
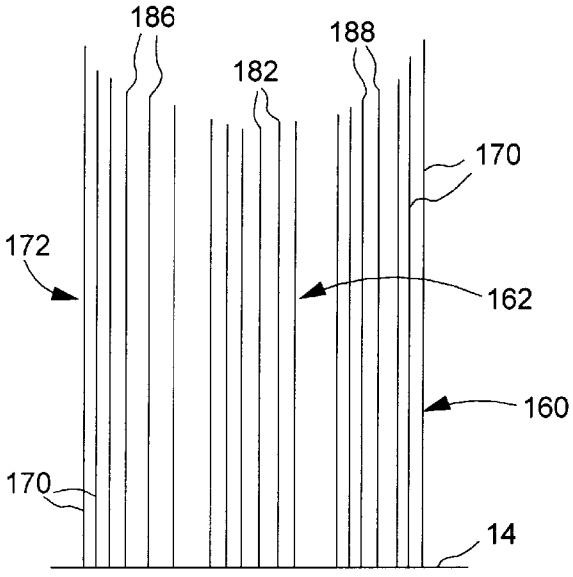

Referring now to FIGS. 3, 4 and 5, a second embodiment of the invention is illustrated. In this embodiment the same reference numerals as the first embodiment are generally employed for corresponding elements, with the exception that the individual tufts extending from head surface 14 are designated as 160, 162, 164, 166, 168, 170, and 172. The individual bristles in tuft 160 are designated as 170, as are the individual bristles in tufts 162 and 164. However, the height of the individual bristles 170 in these tufts is different, with tips 180 of tuft 158 being slanted as shown at FIG. 4, while bristle tips or ends 182 of central tuft 162 are of slightly different height and are not uniformly slanting. Similarly, individual bristles 170 of tuft 164 are slanting, similar to bristles 170 of tuft 158. From a consideration of FIG. 4, the reader will see that the upper ends 180 182 183 of tufts 158 162, and 164 respectively generally form a concave surface. Similarly, the variation of the length to the upper ends 188, 182 and 186 of the bristles of tufts 160, 162, and 172, respectively, as shown at FIG. 5 and is seen to be identical to that of FIG. 4. A section taken along longitudinal axis 12 of tufts 166, 162, and 168 (similar to sections 4—4 and 5—5) would hence be the same as shown at FIGS. 4 and 5. Thus, no matter what the arrangement or pattern of the individual tufts of the head shown at FIG. 4, the end result is a large prophy brush surface, namely, a single concave surface defined by the upper tips or ends of the bristles of all of the tufts and spanning an area substantially equal to the area of the brush head.

As a further modification of the invention, the tufts may be divided into subsets, with the upper ends of the tufts in each subset defining a single concave, prophy-like surface. Thus one subset could be defined by tufts 160, 158, and 166, while another subset could be defined by tufts 164, 172, 168, and 162. The subsets are non overlapping, but one subset may share one or more peripheral tufts with another next neighboring subset.

Thus a toothbrush may be formed according to this invention wherein the upper end of each plural bristle tuft defines a single prophy-like surface (see FIGS. 1 and 2), or wherein all of the upper ends taken together define a single prophy-like surface (see FIGS. 3, 4, and 5), or wherein the tufts are divided into subsets, with the upper ends of each subset defining a single prophy-like surface (see FIG. 3).

Figure 6:
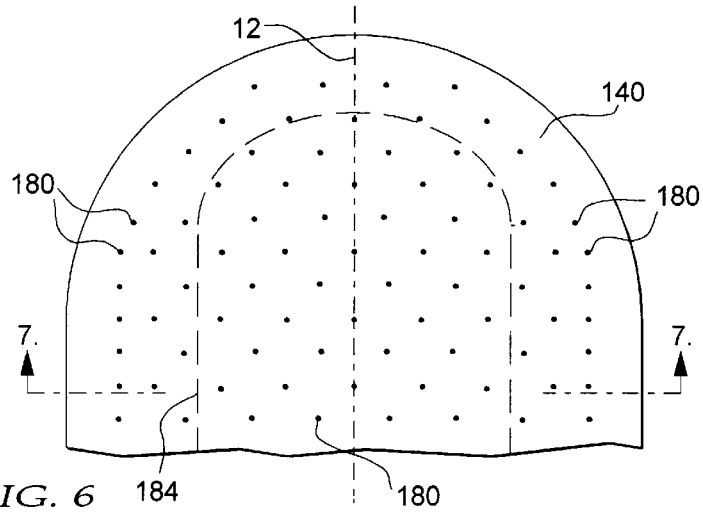
FIG. 6 is a plan view, similar to FIG. 1, and shows a toothbrush head wherein all of the tufts thereon are single-bristle tufts.
Figure 7:
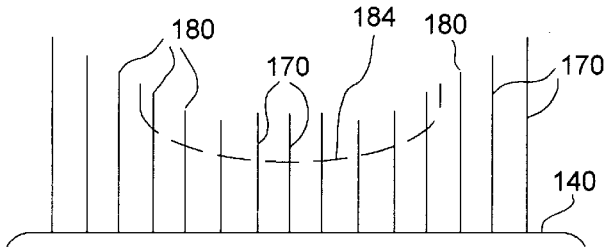
FIG. 7 is a view taken along section 7—7 of FIG. 6.

FIGS. 6 and 7 illustrate yet another form of the invention wherein each tuft on the toothbrush head is a single-bristle tuft, with no two bristles touching each other. Such a construction may be carried out, for example, by the known fusion process which permits the insertion of single bristles into the toothbrush head. FIG. 6 shows that the placement or arrangement of the bristles is substantially the same as tufts (of bristles) 16 shown in FIGS. 1 and 3, namely, the spacing between the bristles is more or less uniform, but other arrangements may be selected. The individual bristles 170 at FIGS. 6 and 7 are so arranged that their tips 180 lie on (or, synonymously, define) an imaginary single and continuous concave surface over the entire head area, as shown at FIG. 7. It will be understood that section 7—7 of FIG. 6 could be taken across any diameter of the head and yield a section or form similar to that shown at FIG. 7.

Figure 8:
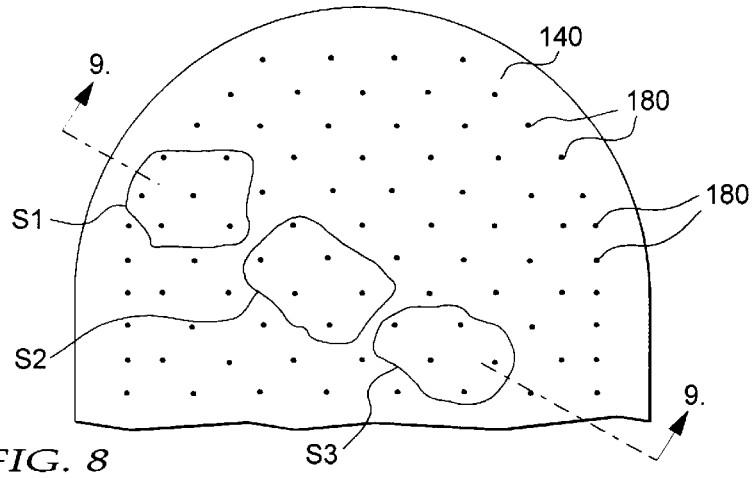
FIG. 8 is a plan view similar to FIG. 6 showing a toothbrush head wherein all of the tufts thereon are single-bristle tufts which are arranged in subgroups.
Figure 9:
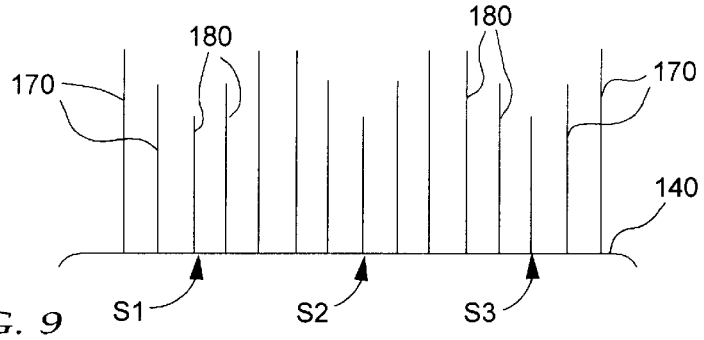
FIG. 9 is a view taken along section 9—9 of FIG. 8 showing that each subgroup forms its own single substantially continuous concave form.

Referring now to FIGS. 8 and 9, another toothbrush head is shown which is identical to that of FIG. 6 except that the individual single-bristle tufts 170 are arranged in subgroups S-1, S-2, S-3, etc. One subset may share one or more peripheral bristles with the periphery of another next neighboring subset, but otherwise the subsets are non overlapping. All of the subgroups fill the head surface. Each subgroup is characterized by having its respective single-bristle tips 180 lying on an imaginary single concave surface. The arrangement may be such that all of the subgroups S-1, S-2, S-3, etc. are of the same size (same number of single bristles), or the arrangement may be such that the subgroups are of different sizes (different number of single bristles). FIG. 9 shows that the tips 180 of each subgroup form their own respective single substantially continuous concave surface. Further, the perimeter or shape (in plan view) of each subgroup S may be arbitrarily chosen, such as irregular, diamond shaped, round, elliptical, etc.

Again referring to FIGS. 6 and 7, dashed lines 184 denote a groove formed by cutting off a portion of the tips 180 of individual bristles 170. As shown at FIG. 6, the groove is aligned with longitudinal axis 12, the groove typically running centrally of the toothbrush. The function of the groove is to define a supporting site for a ribbon of toothpaste squeezed from a tube. Similarly, such a grooved modification may be made in the other forms of the invention. In the embodiment of FIG. 1, such a groove 184 (necessarily discontinuous) may be provided in each of those groups 16 which are aligned with axis 12. In the embodiment of FIG. 3 a similar discontinuous groove may be formed in those groups 168, 162, 166 which are aligned with axis 12. Alternatively, such a groove may be formed in each of any three aligned groups. Likewise, in the embodiment of FIG. 8, such a groove may be formed in any of the aligned subgroups, such as S-1, S-2, S-3.

What is claimed is:

1. A toothbrush head comprising a plurality of bristles arranged to form a plurality of tufts, said bristles of each said tuft having tips, said bristles of each tuft having varying lengths, said tips of all of said tufts defining a single substantially continuous concave surface, wherein said concave surface is provided with a groove, said groove adapted to hold a ribbon of toothpaste.

2. A toothbrush head comprising a plurality of bristles arranged to form a plurality of tufts, said bristles of each said tuft having tips, said bristles of each tuft having varying lengths, said tufts divided into subsets of contiguous and non-overlapping tufts, said tips defining a single substantially continuous concave surface for each of said subsets, wherein said subsets are each provided with a groove, said grooves being aligned, said grooves adapted to hold a ribbon of toothpaste.

3. A toothbrush head comprising a plurality of bristles, no two bristles being in contact with each other, said bristles having varying lengths, said bristles having upper tips defining a single substantially continuous concave surface for all of said bristles, wherein said concave surface is provided with a groove, said groove adapted to hold a ribbon of toothpaste.

4. A toothbrush head comprising a plurality of bristles arranged to form a plurality of tufts, said bristles of each tuft having tips, said bristles of each tuft having varying lengths, said tips defining a single, substantially continuous concave surface for each said tuft, wherein each of said concave surfaces is provided with a groove, said grooves being aligned, said grooves adapted to hold a ribbon of toothpaste.

* * * * *